US007062890B2

(12) United States Patent
Tale' et al.

(10) Patent No.: US 7,062,890 B2
(45) Date of Patent: Jun. 20, 2006

(54) PACKING MACHINE

(75) Inventors: Fabrizio Tale', Bologna (IT); Mario Spatafora, Granarolo (IT)

(73) Assignee: G.D Societa' per Azioni, Bologna (IT)

( * ) Notice: Subject to any disclaimer, the term of this patent is extended or adjusted under 35 U.S.C. 154(b) by 10 days.

(21) Appl. No.: 10/984,949

(22) Filed: Nov. 9, 2004

(65) Prior Publication Data

US 2005/0126120 A1 Jun. 16, 2005

(30) Foreign Application Priority Data

Nov. 13, 2003 (IT) ..... BO2003A0672

(51) Int. Cl.
*B65B 11/28* (2006.01)

(52) U.S. Cl. ..... 53/234; 53/225; 53/228

(58) Field of Classification Search ..... 53/234, 53/225, 228, 461, 462, 466; 493/176–178
See application file for complete search history.

(56) References Cited

U.S. PATENT DOCUMENTS

| | | | | |
|---|---|---|---|---|
| 4,962,634 | A * | 10/1990 | Boldrini et al. | 53/234 |
| 5,113,638 | A * | 5/1992 | Focke et al. | 53/462 |
| 5,549,537 | A * | 8/1996 | Focke et al. | 493/162 |
| 5,600,935 | A * | 2/1997 | Isani et al. | 53/234 |
| 5,771,666 | A * | 6/1998 | Bertuzzi et al. | 53/466 |
| 5,806,289 | A * | 9/1998 | Sassi et al. | 53/575 |
| 6,698,158 | B1 * | 3/2004 | Spatafora | 53/77 |

FOREIGN PATENT DOCUMENTS

| | | | |
|---|---|---|---|
| DE | 195 29 798 | | 3/1996 |
| EP | 0 933 296 | | 8/1999 |
| EP | 1 319 597 | | 6/2003 |
| EP | 1 321 364 | | 6/2003 |
| EP | 1 321 365 | | 6/2003 |
| FR | 2.019.941 | * | 7/1970 |

OTHER PUBLICATIONS

English Abstract of DE 195 29 798 dated Mar. 7, 1996.

* cited by examiner

*Primary Examiner*—Stephen F Gerrity
*Assistant Examiner*—Thanh Truong
(74) *Attorney, Agent, or Firm*—Ladas & Parry

(57) ABSTRACT

A packing machine provided with a wrapping conveyor moving along a wrapping path and having a plurality of recesses each of which is designed to receive a respective article together with a respective wrapping sheet; and with a plurality of folding stations successively arranged along the wrapping path, each folding station comprising folding units arranged to cooperate with the wrapping sheets to fold the same around respective articles; the folding unit in at least one of the folding station has a folding device presenting a fixed block and a movable block defining respective contiguous flat surfaces blending along a fold line; the movable block is activated by an articulated parallelogram actuating device having two connecting rods connected by cranks hinged to the fixed block to rotate, with respect to the fixed block, about respective axes parallel to the fold line; the movable block being hinged to the two connecting rods, and defining a further crank rotating, with respect to the fixed block, about an axis coincident with the fold line.

7 Claims, 3 Drawing Sheets

PACKING MACHINE

The present invention relates to a packing machine.

More specifically, the present invention relates to a cigarette packing machine, to which the present invention refers purely by way of example.

BACKGROUND OF THE INVENTION

A standard cigarette packing machine comprises a wrapping conveyor moving along a substantially circular wrapping path and having a plurality of recesses each of which is designed to receive a respective article together with a respective wrapping sheet; a plurality of folding stations successively arranged along the wrapping path, each folding station comprising folding means arranged to cooperate with the wrapping sheets to fold the same along pre-formed folding lines and around respective articles; a first of the folding stations is an insertion station arranged to insert each wrapping sheets inside a respective recess in the wrapping conveyor, and the last of the folding stations is an outlet or discharge station for discharging the packaged articles or the partially packaged articles from the wrapping conveyor.

Normally, the folding means in at least one of the folding station comprise one folding device of the type comprising a fixed member having a first flat surface; a movable member having a second flat surface; and an actuating device for activating the movable member to rotate the movable member between a rest position, in which said two surfaces are coplanar and define a supporting surface for a flat portion of the wrapping sheet to be folded, and a work position, in which said two surfaces form an angle of less than 180° so as to fold such portion of the wrapping sheet.

In known folding devices of the type described above, the fixed member and the movable member are connected by a hinge, the axis of which coincides with the axis of rotation of the movable member with respect to the fixed member. Since the supporting surface referred to must have no projections, the hinge must be located behind the supporting surface, with the result that the axis of rotation is actually located some distance from the supporting surface, and, as the second surface rotates with respect to the first, the line of intersection between the two surfaces moves crosswise to itself, and eventually reaches a final position when the movable member reaches said work position.

Consequently, when a flat portion of the wrapping sheet is placed on the supporting surface, rotation of the movable member about said axis of rotation results in the wrapping sheet sliding along the second surface, and in various other phenomena, which vary depending on whether or not the wrapping sheet has a preformed fold line.

In the absence of a preformed fold line, rotation of the movable member produces, along the wrapping sheet, an elbow located at the line of intersection and which moves with it gradually reducing its radius of curvature and so increasing the compressive stress within the wrapping sheet. For a given wrapping sheet thickness and given rotation speeds of the movable member, such stress may exceed the critical combined bending and compressive stress of the wrapping sheet, thus resulting, due to collapse of the wrapping sheet, in the formation of false folds before the line of intersection reaches the final position.

If there is a preformed fold line, collapse of the wrapping sheet always occurs along the preformed fold line, though the wrapping sheet is still forced to slide along the second surface, possibly undergoing damage and forming wrinkles.

U.S. Pat. No. 4,055,066A1 relates to an automatic apparatus for forming bends in sheet metal or any other deformable material, and particularly sheet metal of large dimensions. The automatic apparatus includes a bending unit with a fixed frame, female holding means for clamping the sheet in a vertical alignment, mobile tables for bending the sheet, which tables rotate on an axis parallel to the longitudinal axis of the apparatus on respective intermediary supports; each intermediary support is independently moveable on the fixed frame from one position corresponding to a retracted position of the table to a second position which is a working position of the table. The intermediary supports and tables are independently operable.

FR2019941A discloses an apparatus for forming bends in sheet metal of large dimensions, wherein a fixed block and a movable block activated by an articulated parallelogram define respective contiguous flat surfaces blending along a fold line; the actuating device has two connecting rods connected by cranks hinged to the fixed block to rotate, with respect to the fixed block, about respective axes parallel to the fold line, and the movable block is hinged to the two connecting rods, and defines a further crank rotating, with respect to the fixed block, about an axis coincident with the fold line.

SUMMARY OF THE INVENTION

It is an object of the present invention to provide a device of the type described above, designed to eliminate the aforementioned drawbacks.

According to the present invention, there is provided a packing machine as claimed in the attached claims.

BRIEF DESCRIPTION OF THE DRAWINGS

A non-limiting embodiment of the invention will be described by way of example with reference to the accompanying drawings, in which.

DETAILED DESCRIPTION OF THE INVENTION

Figure 1:
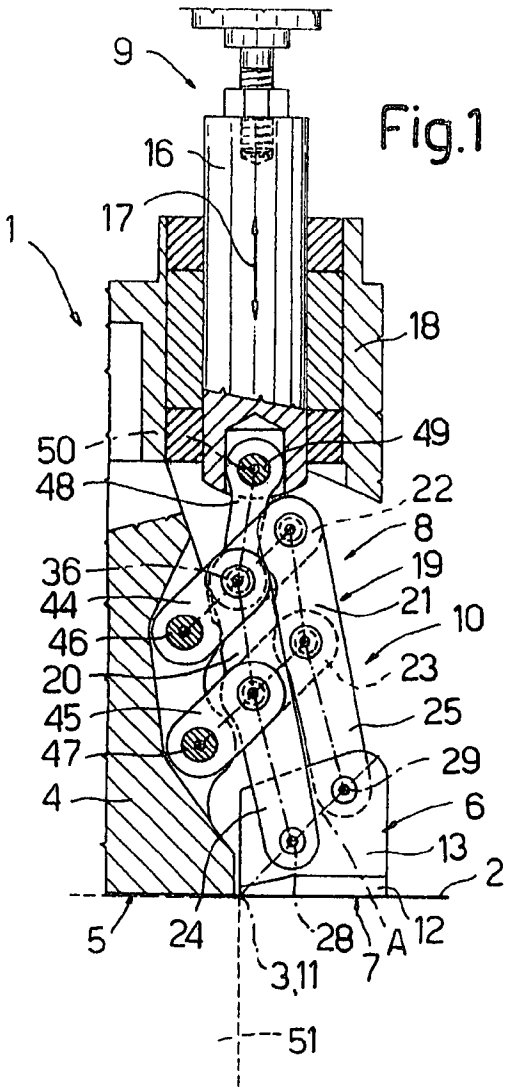

Number 1 in FIG. 1 indicates as a whole a folding device for folding an originally flat wrapping sheet 2 about a fold line 3.

Folding device 1 comprises a fixed block 4 having a flat lateral surface 5 perpendicular to the FIG. 1 plane; a movable block 6 having a flat lateral surface 7 also perpendicular to the FIG. 1 plane; and an actuating device 8, in turn comprising a linear actuator 9 supported by fixed block 4, and an articulated parallelogram transmission 10 which is supported by fixed block 4, supports movable block 6, and is interposed between linear actuator 9 and movable block 6.

Fixed block 4 and movable block 6 are arranged with respect to each other so that surfaces 5 and 7 are contiguous and blend along a line 11 perpendicular to the FIG. 1 plane and coincident, in use, with fold line 3.

Movable block 6 comprises a plate 12, one surface of which is defined by surface 7, and an opposite surface of which is fitted with an appendix 13 bounded laterally by two lateral surfaces 14, 15 perpendicular to surface 7 and line 11.

Linear actuator 9 comprises an output rod 16 movable between a withdrawn rest position and a forward work position in a direction 17 perpendicular to surface 5, and through a guide sleeve 18 integral with the opposite end of fixed block 4 to that defined by surface 5.

Figure 4:
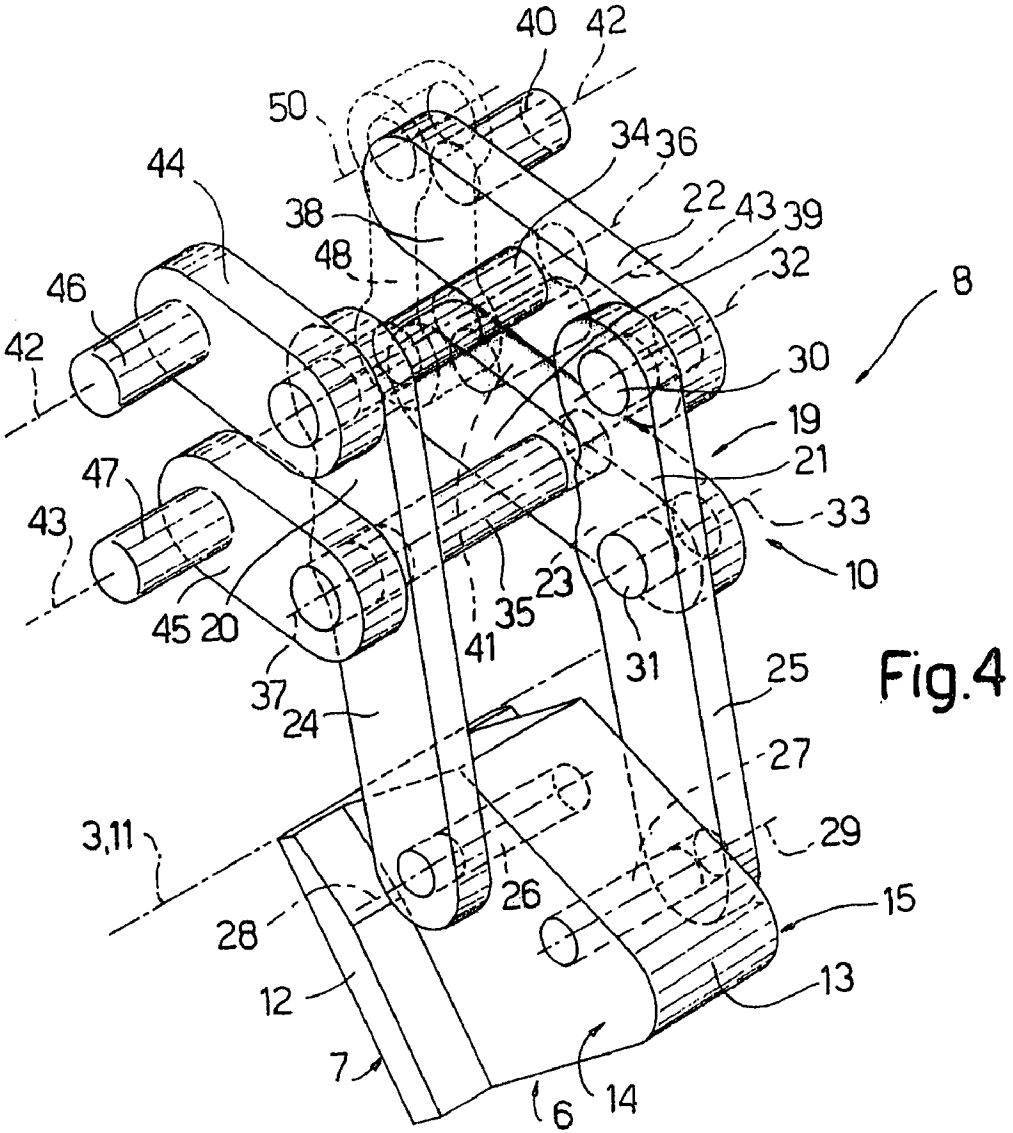
FIG. 4 shows a larger-scale view in perspective of a detail in FIGS. 1 to 3.

With reference to FIG. 4, transmission 10 comprises an articulated parallelogram 19 defined by two connecting rods 20, 21 extending in a direction close to direction 17, and of which connecting rod 20 is interposed between fixed block 4 and connecting rod 21, and by two cranks 22, 23, of which crank 23 is interposed between movable block 6 and crank 22.

Respective arms 24 and 25 of connecting rods 20 and 21 extend beyond crank 23 towards movable block 6, are located on opposite sides of appendix 13, and are hinged at their respective free ends to respective lateral surfaces 14 and 15 of appendix 13 by means of respective pins 26 and 27, the axes 28 and 29 of which are parallel to each other and to line 11 and define a plane A parallel to cranks 22 and 23 and through line 11.

Connecting rod 21 is hinged directly to cranks 22 and 23 by respective pins 30 and 31, the axes 32 and 33 of which are parallel to line 11; and connecting rod 20 is hinged to cranks 22 and 23 by respective pins 34 and 35, the axes 36 and 37 of which are parallel to line 11.

Respective arms 38 and 39 of cranks 22 and 23 extend beyond respective pins 34 and 35 towards fixed block 4, and are hinged at their free ends to fixed block 4 by respective pins 40 and 41, the axes 42 and 43 of which are parallel to line 11; connecting rod 20 is connected to fixed block 4 by two auxiliary cranks 44, 45 parallel to cranks 22 and 23; crank 44 is hinged at one end about pin 34, and at the other end to fixed block 4 by a pin 46 coaxial with axis 42; and crank 45 is hinged at one end about pin 35, and at the other end to fixed block 4 by a pin 47 coaxial with axis 43.

Arms 38 and 39 are equal in length, are the same length as auxiliary cranks 44 and 45, and are equal in length to the distance between axis 28 and line 11, so that movable block 6 acts, mechanically speaking and with respect to connecting rods 20 and 21, as a further crank movable about a virtual hinge whose axis coincides with line 11.

Transmission 10 also comprises a further connecting rod 48 hinged at one end about pin 34, and at the other end to the free end of rod 16 by a pin 49 whose axis 50 is parallel to line 11.

From the foregoing description, operation of folding device 1 is self-explanatory. Given the structure of transmission 10, movement of rod 16 in direction 17 results in rotation of movable block 6 about line 11, which remains coplanar with surface 5 and fixed with respect to fixed block 4 regardless of the movement of rod 16.

Consequently (FIG. 1), if surfaces 5 and 7 are set to a rest position in which surfaces 5 and 7 are coplanar, and a clamping body 51, e.g. a body to be at least partly enclosed in wrapping sheet 2, is placed on surface 5 with wrapping sheet 2 in between and with its own lateral edge coincident with line 11, a given movement of rod 16 towards movable block 6 in direction 17 (FIGS. 2 and 3) gradually rotates movable block 6 about fold line 3, thus resulting in gradual, precise folding of wrapping sheet 2 about fold line 3, which may continue (FIG. 3) until movable block 6 reaches a final work position in which, in the example shown, the folded portion of wrapping sheet 2 is folded 90° onto clamping body 51.

In connection with transmission 10 described above, it should be pointed out that, in the example shown, connecting rods 20 and 21 are only located on opposite sides of movable block 6—thus using pins 34 and 35 longer than the thickness of appendix 13 and auxiliary cranks 44 and 45—to prevent connecting rods 20 and 21, given the small size of movable block 6, from interfering with each other as movable block 6 rotates about line 11, and to improve the stability of transmission 10. If a larger movable block 6 is used and connecting rods 20 and 21 can be spaced further apart, however, both connecting rods 20 and 21 may obviously be located on the same side of movable block 6, so that auxiliary cranks 44 and 45 can be eliminated, and shorter pins 34 and 35 used.

Figure 5:
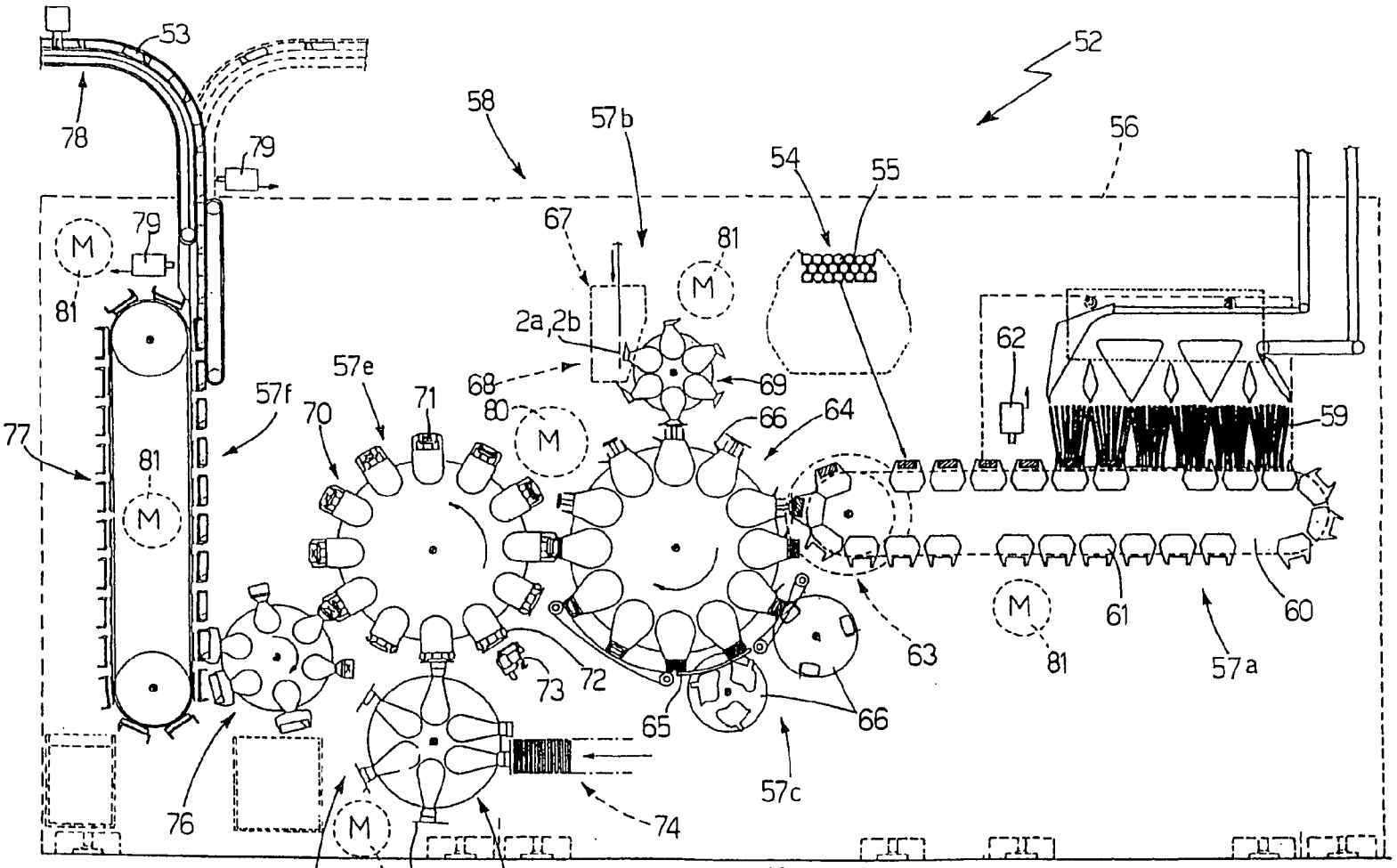
FIG. 5 diagrammatically shows a cigarette packing machine according to the present invention and comprising the folding device of FIGS. 1–4.

Number 52 in FIG. 5 indicates as a whole an automatic packing machine for producing rigid, hinged-lid packets 53 of cigarettes, each of which comprises an orderly group 54 of cigarettes 55 enclosed in a wrapping sheet 2*a* of foil packing material, a collar 2*b* folded about group 54 and over wrapping sheet 2*a*, and a blank 2*c* folded about group 54 and over both wrapping sheet 2*a* and collar 2*b*.

Packing machine 52 is a substantially known type, and comprises a frame 56 shown by the dash line in FIG. 5 and which supports a number of work stations 57 arranged along a production line, and each having a number of operating devices 58. More specifically, packing machine 52 comprises six work stations 57: a work station 57*a* for forming groups 54 of cigarettes 55; a work station 57*b* for supplying wrapping sheets 2*a* of foil packing material and collars 2*b*; a work station 57*c* for folding wrapping sheets 2*a* of packing material and collars 2*b* about respective groups 54; a work station 57*d* for supplying blanks 2*c*; a work station 57*e* for folding blanks 2*c* about respective groups 54 (and over wrapping sheets 2*a* of packing material and collars 2*b*); and a work station 57*f* for drying packets 2.

The following is a description, by way of example, of the main operating devices 58 of each work station 57, as shown in FIG. 1, though, obviously, each work station 57 normally also comprises other operating devices 58 (in particular, control sensors) which, for the sake of simplicity, are not detailed in FIG. 1.

Work station 57*a* for forming groups 54 of cigarettes 55 comprises a hopper 59 for supplying cigarettes 55; a conveyor 60 with trains of pockets 61, each for receiving a respective group 54 of cigarettes 55; optical control devices 62; and a transfer wheel 63.

Work station 57*c* for folding wrapping sheets 2*a* of packing material and collars 2*b* about respective groups 54 comprises a packing wheel 64, which moves along a substantially circular wrapping path and has a plurality of recesses 65 each of which is designed to receive a respective group 54 from transfer wheel 63 and a respective wrapping sheet 2*a* from work station 57*b*. A plurality of folding stations are successively arranged along the wrapping path, each folding station comprising folding units 66, which are carried by or outside packing wheel 64 and are arranged to cooperate with the wrapping sheets 2*a* to fold the same along folding lines 3 and around respective groups 54. A first of the folding stations is an insertion station arranged to insert each wrapping sheets 2*a* inside a respective recess 65, and the last of the folding stations is an outlet or discharge station for discharging the packaged groups 54 or the partially packaged groups 54 from the packing wheel 64.

Work station 57*b* for supplying wrapping sheets 2*a* of foil packing material and collars 2*b* comprises a conveyor 67; a cutting device 68; and a supply wheel 69 for feeding wrapping sheets 2*a* of packing material and collars 2*b* together to packing wheel 64.

Work station 57*e* for folding blanks 2*c* about respective groups 54 (and over wrapping sheets 2*a* of packing material and collars 2*b*) comprises a packing wheel 70, which moves along a substantially circular wrapping path and has a plurality of recesses 71 each of which is designed to receive a respective group 54 from packing wheel 64 together with a respective blank 2*c* from work station 57*d*. A plurality of folding stations are successively arranged along the wrapping path, each folding station comprising folding units 72, which are carried by or outside packing wheel 70 and are arranged to cooperate with the blanks 2*c* to fold the same along pre-scored folding lines 3 and around respective groups 54. A first of the folding stations is an insertion station arranged to insert each blank 2*c* inside a respective recess 71, and the last of the folding stations is an outlet or discharge station for discharging the packaged groups 54 or the partially packaged groups 54 from the packing wheel 70. Work station 57*e* also comprises a gumming device 73 for gumming the blanks 2*c* before the folding of the same.

Work station 57*d* for supplying blanks 2*c* comprises a horizontal store 74 for blanks 2*c*; and a supply wheel 75 for feeding blanks 2*c* to packing wheel 70.

Work station 57*f* for drying packets 2 comprises a transfer and reject wheel 76; a drying conveyor 77; a gumming device (not shown); an output conveyor 78; and optical control devices 79.

Packing machine 52 also comprises a main electric motor 80 for powering packing wheels 64 and 70 (with relative folding units 66 and 72) and transfer wheels 63 and 76; and a number of secondary electric motors 81 for powering conveyor 60, supply wheels 69 and 75, drying conveyor 77, and output conveyor 78.

Figure 3:
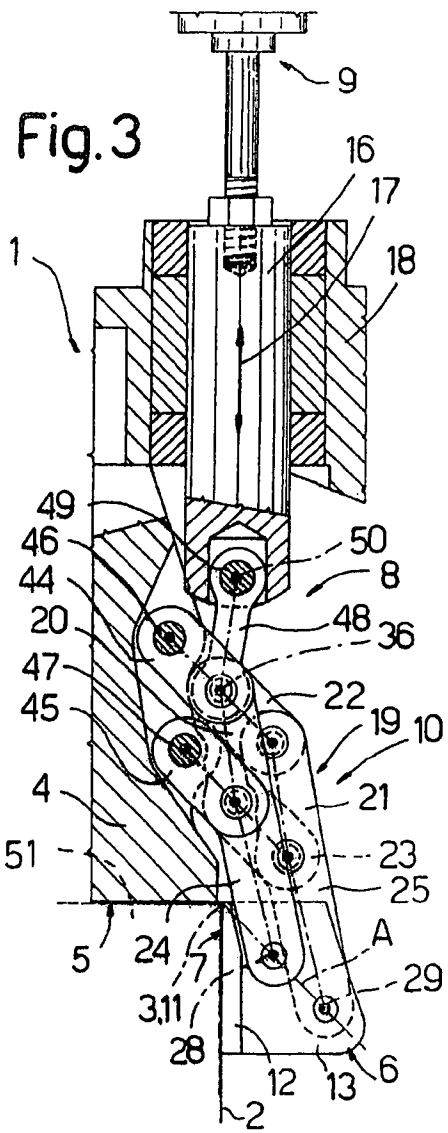
FIGS. 1 to 3 show schematic sections of a preferred embodiment of a folding device.
Figure 2:
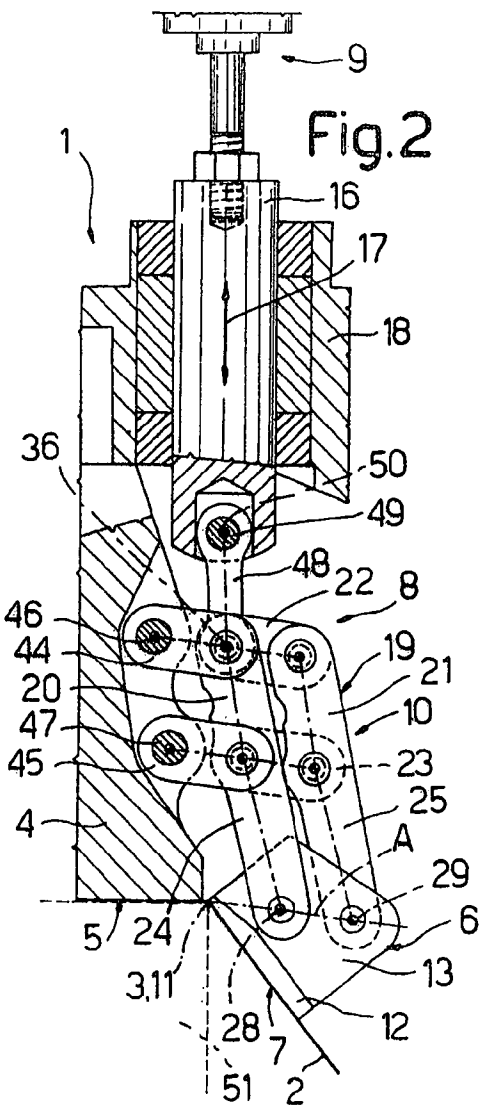

The folding units 66 and/or 72 in at least one of the aforementioned folding station comprise one folding device 1 of the type shown in FIGS. 1–3.

The invention claimed is:

1. Packing machine (52) comprising:

a wrapping conveyor (64; 69) moving along a wrapping path and having a plurality of recesses (65; 71) each of which is designed to receive a respective article (54) together with a respective wrapping sheet (2); and a plurality of folding stations successively arranged along the wrapping path, each folding station comprising folding means (66; 72) arranged to cooperate with the wrapping sheets (2) to fold the same around respective articles (54);

wherein the folding means (66; 72) in at least one of the folding station comprise a folding device (1) comprising a fixed block (4) having a flat first surface (5); a movable block (6) having a flat second surface (7); and an actuating device (8) for activating the movable block (6) to rotate the movable block (6) between a rest position, in which said first and second surface (5, 7) are coplanar and define a supporting surface for a flat wrapping sheet (2) to be folded, and a work position, in which said first and second surface (5, 7) form an angle of less than 180°;

the packing machine (52) is characterized in that said first and second surface (5, 7) are contiguous and blend along a fold line (3); said actuating device (8) comprising an articulated parallelogram transmission (10), in turn comprising a first and a second connecting rod (20, 21) and a first and a second crank (22, 23); said first and said second crank (22, 23) being hinged to said fixed block (4) to rotate, with respect to the fixed block (4), about respective first axes (42, 43) parallel to the fold line (3); said first and said second connecting rod (20, 21) being hinged to said movable block (6) to rotate, with respect to the movable block (6), about respective second axes (28, 29) parallel to said fold line (3); and said movable block (6) defining a further crank rotating, with respect to the fixed block (4), about a virtual hinge having a third axis (11) coincident with said fold line (3).

2. A packing machine (52) as claimed in claim 1, wherein said second axes (28, 29) define a plane (A) through said fold line (3).

3. A packing machine (52) as claimed in claim 1, wherein said first connecting rod (20) is located in an intermediate position between said fixed block (4) and said second connecting rod (21); said first and said second crank (22, 23) being hinged to said first connecting rod (20) to rotate, with respect to said first connecting rod (20), about respective fourth axes (36, 37) parallel to said fold line (3), and extending beyond said first connecting rod (20) towards said fixed block (4) and towards the relative said first axes (42, 43).

4. A packing machine (52) as claimed in claim 3, wherein each said fourth axis (36; 37) is located at a distance from the relative said first axis (42; 43) equal to a distance between the second axis (28) of said first connecting rod (20) and said fold line (3).

5. A packing machine (52) as claimed in claim 1, wherein said transmission (10) comprises two further cranks (44, 45); said second connecting rod (21) being connected to said fixed block (4) directly by said first and said second crank (22, 23); and said first connecting rod (20) being connected to said fixed block (4) directly by said further cranks (44, 45), which are hinged to the fixed block (4) to rotate, with respect to the fixed block (4), about said first axes (42, 43), and are hinged to said first connecting rod (20) to rotate, with respect to the first connecting rod (20), about said fourth axes (36, 37).

6. A packing machine (52) as claimed in claim 1, wherein said first and said second connecting rod (20, 21) are spaced transversely apart and located on opposite sides of said movable block (6).

7. A packing machine (52) as claimed in claim 1, wherein a first of the folding stations is an insertion station arranged to insert each wrapping sheets (2) inside a respective recess (65; 71) in the wrapping conveyor (64; 69), and the last of the folding stations is an outlet or discharge station for discharging at least partially packaged articles (54) from the wrapping conveyor (64; 69).

* * * * *